US007500423B2

(12) United States Patent
Strand

(10) Patent No.: US 7,500,423 B2
(45) Date of Patent: Mar. 10, 2009

(54) METHOD OF MAKING A PROJECTILE IN A TRAJECTORY ACT AT A DESIRED POINT AT A CALCULATED POINT OF TIME

(75) Inventor: Patrik Strand, Mjölby (SE)

(73) Assignee: Totalforsvarets Forskningsinstitut, Stockholm (SE)

( * ) Notice: Subject to any disclaimer, the term of this patent is extended or adjusted under 35 U.S.C. 154(b) by 581 days.

(21) Appl. No.: 10/548,292

(22) PCT Filed: Mar. 4, 2004

(86) PCT No.: PCT/SE2004/000309

§ 371 (c)(1),
(2), (4) Date: Sep. 6, 2005

(87) PCT Pub. No.: WO2004/079289

PCT Pub. Date: Sep. 16, 2004

(65) Prior Publication Data

US 2006/0185506 A1 Aug. 24, 2006

(30) Foreign Application Priority Data

Mar. 4, 2003 (SE) ..... 0300560

(51) Int. Cl.
*F41G 3/00* (2006.01)

(52) U.S. Cl. ..... 89/41.03; 89/1.11; 235/404

(58) Field of Classification Search ..... 89/41.03, 89/204, 1.11, 41.04, 41.06, 41.07, 41.08, 89/41.14, 41.22; 235/404, 408, 412, 417, 235/405, 407, 409

See application file for complete search history.

(56) References Cited

U.S. PATENT DOCUMENTS

| | | | | |
|---|---|---|---|---|
| 3,686,478 | A * | 8/1972 | Goldberg et al. | 235/417 |
| 4,038,521 | A * | 7/1977 | Baumann | 235/404 |
| 4,111,382 | A | 9/1978 | Kissinger | |
| 4,402,250 | A * | 9/1983 | Baasch | 89/41.11 |
| 4,494,198 | A | 1/1985 | Smith et al. | |
| 4,568,823 | A * | 2/1986 | Diehl et al. | 235/404 |
| 5,140,329 | A * | 8/1992 | Maughan et al. | 342/67 |
| 5,413,029 | A * | 5/1995 | Gent et al. | 89/41.03 |
| 5,467,682 | A * | 11/1995 | Brooks | 89/41.22 |
| 6,739,233 | B2 * | 5/2004 | Malakatas | 89/41.01 |
| 7,121,183 | B2 * | 10/2006 | Waid et al. | 89/1.11 |
| 7,210,392 | B2 * | 5/2007 | Greene et al. | 89/41.03 |
| 2001/0047248 | A1 * | 11/2001 | Toth et al. | 702/104 |
| 2007/0159379 | A1 * | 7/2007 | Bannasch et al. | 342/67 |

* cited by examiner

*Primary Examiner*—Bret Hayes
*Assistant Examiner*—Benjamin P Lee
(74) *Attorney, Agent, or Firm*—Jacobson Holman PLLC

(57) ABSTRACT

A method of calculating in near-real-time two possible angles of elevation of a projectile and associated times of flight so that the projectile can be made to act at a desired point The angle of elevation of the launching direction of the projectile and the time of flight are calculated in a process which is divided into two main parts, a calculation part which discretely timed calculates positions and associated points of time along a trajectory, and a logic part which sets a first direction of elevation, monitors the calculation of projectile positions and time of flight and interrupts the calculation at specified points to determine a solution, Then the logic part sets a second direction of elevation until two solutions have been found.

15 Claims, 4 Drawing Sheets

Figure 1:
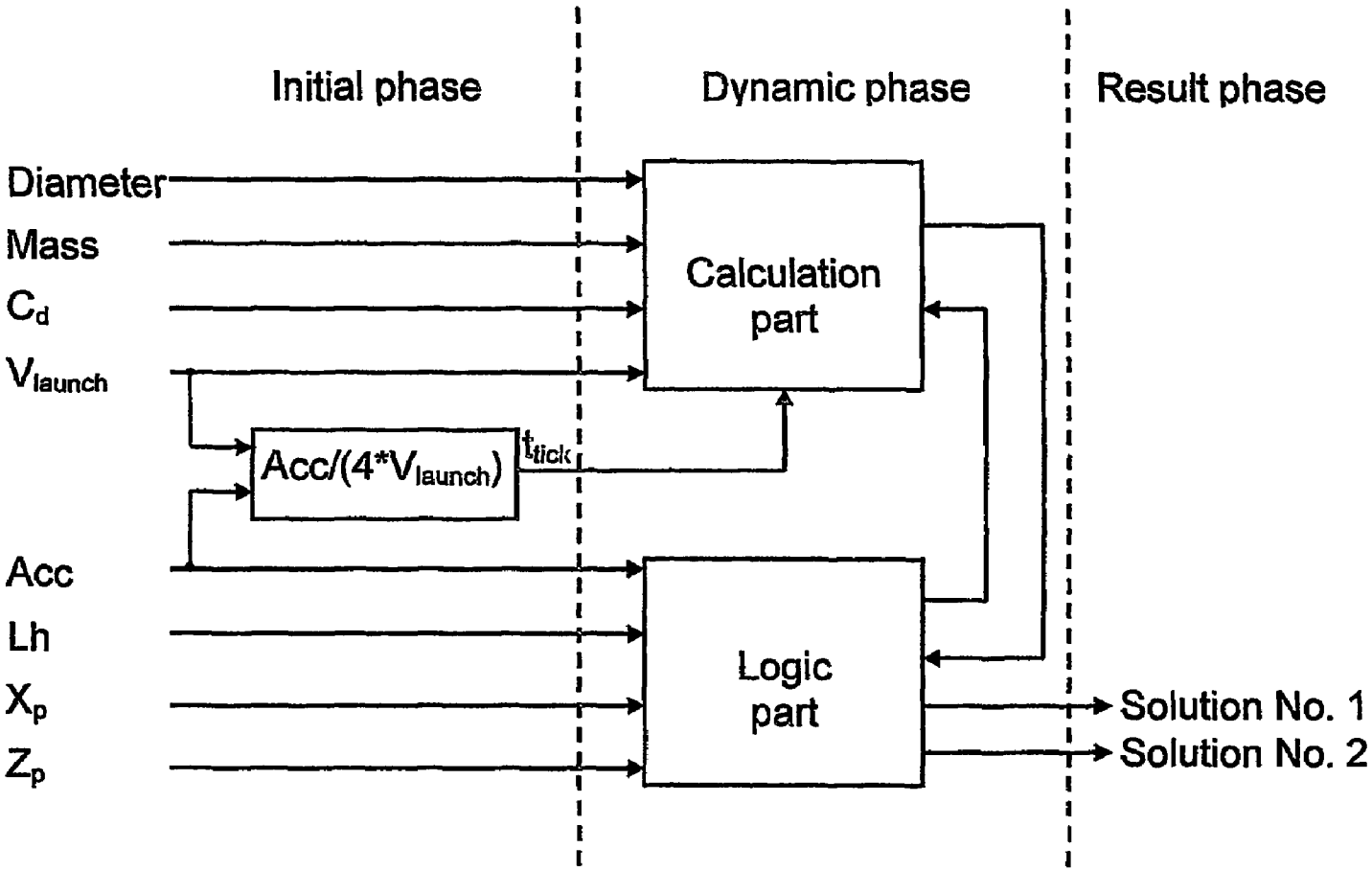

METHOD OF MAKING A PROJECTILE IN A TRAJECTORY ACT AT A DESIRED POINT AT A CALCULATED POINT OF TIME

This is a nationalization of PCT/SE2004/000309 filed 4 Mar. 2004 and published in English.

BACKGROUND OF THE INVENTION

1. Field of the Invention

The present invention relates to a method of making, in near-real-time, a projectile in a trajectory act at a point, known in distance and height, by means of calculated angle of elevation and time of flight. The method can be used either as a pc-based support or as a component in an integrated system for delivering projectiles.

2. Description of Related Art

The lateral alignment (azimuth) will not be discussed here, but is assumed to take place in some prior-art manner, for instance by direct measurement of the direction to a target.

3. Summary of the Invention

The optimising method consists essentially of two parts, a calculation part which discretely timed calculates positions and associated points of time along a trajectory, and a logic part which sets a first direction of elevation, monitors the calculation in the calculation part and interrupts the same when a calculated position lies outside predetermined limit values and, after that, sets a second direction of elevation etc. The logic part determines and establishes two solutions in the form of direction of elevation and time of flight.

The optimising method is intended for trajectory systems that have been subjected to launch trial to such an extent that specific properties of the air drag parameters of the grenade/projectile could be identified. The method can also be used for the actual identification of the air drag parameters. For projectiles with a higher initial velocity, it is possible, by launch trial, to carry out identification of the possible dependence of the air drag on temperature, atmospheric pressure and air humidity. Based on an established relationship of this kind, the thus variable air drag can be used in the calculations in a variant of the invention, which will be possible since the current height in each time step is available.

Based on the measured position of a target, the method can be used to obtain, quickly and with the selected accuracy, a response to how the launching device is to be elevated in order to reach the target. The method also supplies output data for the required time of flight that will be needed in the trajectory from firing until the grenade/projectile reaches the target.

When you want to lead away enemy missiles using countermeasure ammunition, you have a tactical idea that causes a desired specific trajectory pattern. To be able to achieve this pattern, you must know how the launching device is to be elevated and also the time until the effect of the intended countermeasure. It is easy to describe target positions in distance, height and azimuth based on the tactical idea, but it is not easy to reach them using previously known methods. In such countermeasure systems, the time from the discovery of a threat until the time when the effect at predetermined target positions round one's own position, a ship etc, is desired, is short-in many cases very short. This requires extreme rapidity of a system for calculating the alignment of launching device and for fuse time setting of grenades. It is such a system that has been the incentive in the conception of the invention. However, the invention can also be used in other systems which give trajectories, such as in grenade launchers and howitzers, and in support for prediction algorithms for fighting against moving targets using automatic guns and the like.

Applicant has the pronounced opinion that the invention should relate to all applications of the inventive method.

The present invention means concretely that the distance and height can be replaced by angle of elevation which directly can control a launcher. Using grenades with variable fuse time setting, it will then be possible to reach the correct position at the desired point of time. In the example involving naval launchers, chaff can be made to blossom out or a pyrotechnic charge can be initiated.

The invention replaces the use of unreliable firing diagrams which often are most inaccurate and solves the problem of making, in near-real-time, a projectile in a trajectory act at a point, known in distance and height, at a desired point of time. This occurs by the invention being designed as will be evident from the independent claim. Suitable embodiments of the invention will appear from the remaining claims.

4. Brief Description of The Drawings

Figure 2:
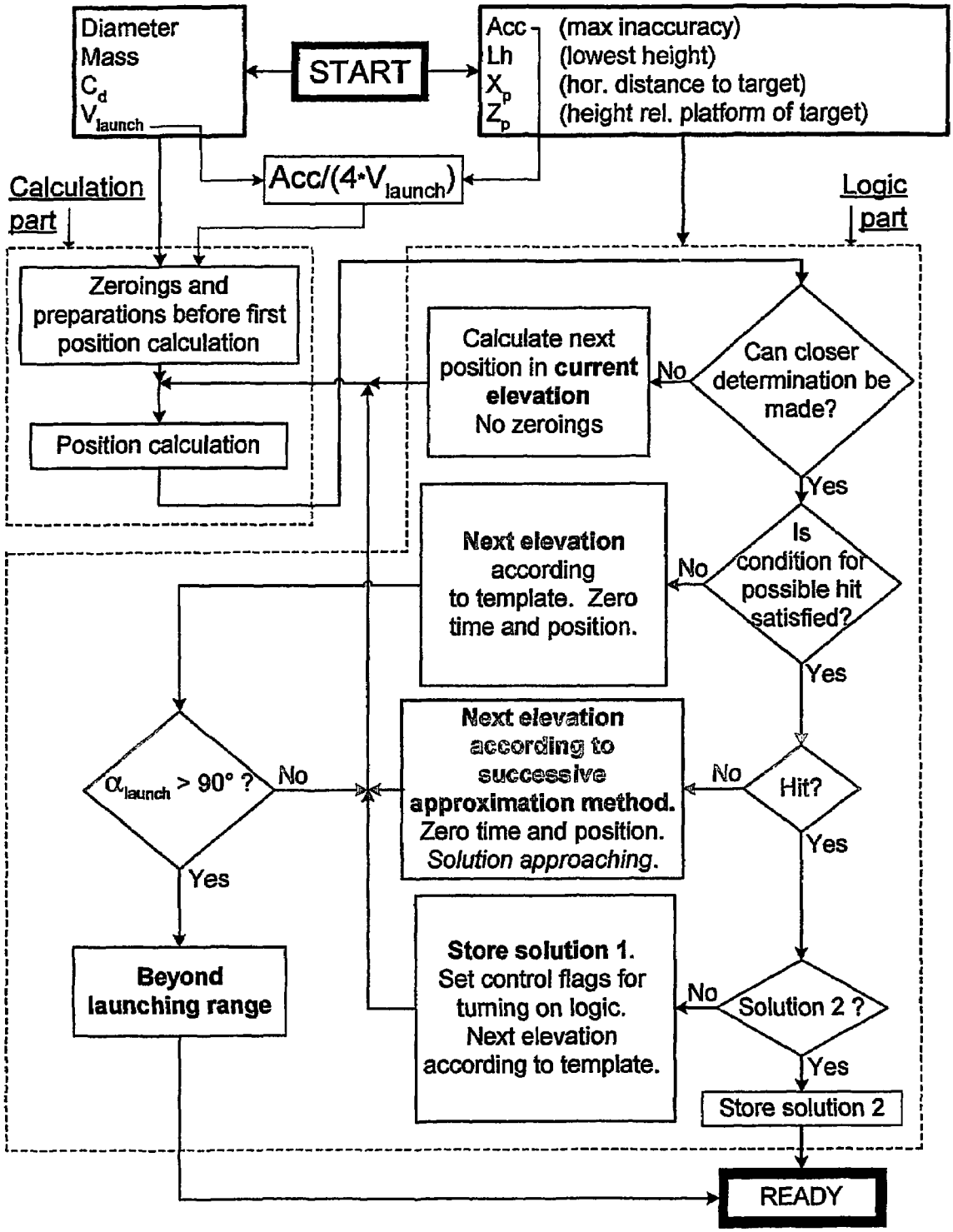
Figure 3:
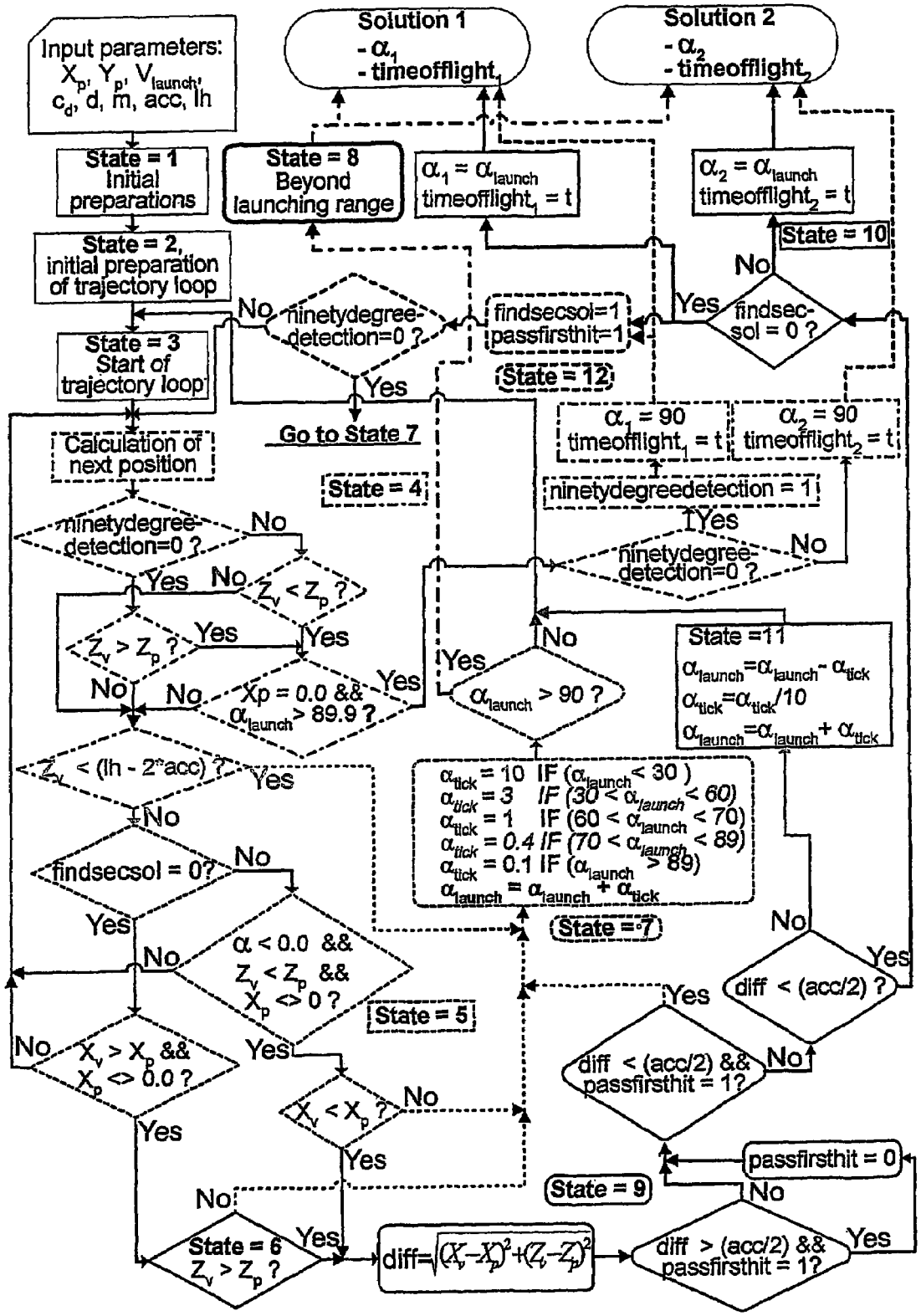
Figure 4:
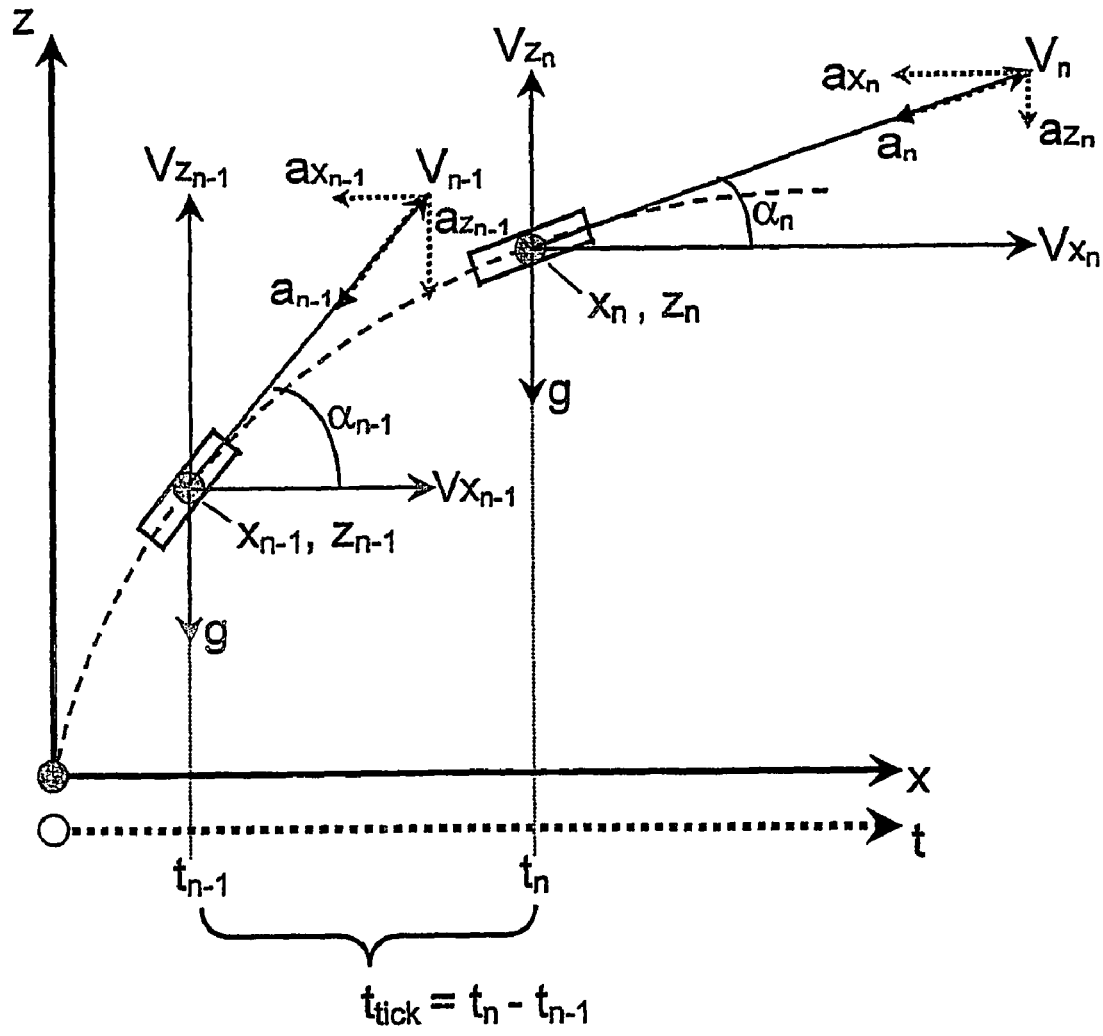

The invention will now be described in more detail with reference to the accompanying drawing in which FIG. 1 shows the basic division of the invention into a calculation part and a logic part, FIG. 2 shows at a fundamental level the make-up of the calculation part and the logic part in FIG. 1, FIG. 3 shows a complete flow chart of the invention; and FIG. 4 shows a projectile in a trajectory in the plane x, z, and also acceleration and speed with associated vectors of the projectile at two close points of time.

Detailed Description of The Preferred Embodiments

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention consists essentially of two parts, a calculation part and a logic part, see FIG. 1. The parts are closely associated and bound to and in each other, but nevertheless their properties can to some extent be described each separately.

For the two parts to be able to start and work continuously in a correct manner, they must initially collect the 8 initial parameters, viz.

| Denomination | Name of variable |
|---|---|
| Projectile diameter | d [m] |
| Mass | m [Kg] |
| Launching speed | $V_{launch}$ [m/s] |
| Air drag coefficient | $C_d$ |
| Lower limit of desired height (lower limit of conceivable target height) | lh [m] |
| Maximum inaccuracy of output data | acc [m] |
| Horizontal distance to target | $x_p$ [m] |
| Relative height to target | $z_p$ [m] |

First the time step, $t_{tick}$, which is used in the dynamic phase, is calculated. The time step is dimensioned so as to match the use of maximum inaccuracy, acc, in the logic part. Thus independently of which combination is selected between launching speed, $V_{launch}$, and maximum inaccuracy, acc, the logic part can always operate in the correct operating range where comparisons are made based on the size of acc.

The calculation part calculates all the time the next position of a projectile along a trajectory at a certain angle of elevation. The logic part controls the calculation part and prevents it, for instance, from making unnecessary calculations. The logic part thus interrupts the calculation of the calculation part when success cannot be obtained at a certain angle of elevation, and instead initiates a new series of calculations at a selected new angle of elevation. It also controls in which of several different selectable manners a new angle of elevation is to be incremented. The connections between the calculation part and the logic part are fundamentally summed up in FIG. 2.

With reference to FIG. 3, the complete logic chart will be presented below, the invention being described by way of twelve different conditions, which in the Figure are referred to as states. In the respective paragraphs below, program code will be presented in parallel with the explanatory text.

State 1

| | |
|---|---|
| $X_v = 0.0$ | Zeroing of horizontal distance before validation of the first trajectory [m]. |
| $z_v = 0.0$ | Zeroing of initial value of height relative to target before validation of the first trajectory [m]. |
| $t_{tic} = acc/(4*V_{launch})$ | Time step for discrete calculation of trajectories [s]. |
| deg2rad = π/180 | Conversion factor (degrees to radians). |
| rad2deg = 180/π | Conversion factor (radians to degrees). |
| p = 1.2 | Density of air [g/m$^3$]. |
| g = 9.81 | Acceleration of gravity [m/s$^2$]. |
| area = $\pi*d^2/4$ | Cross-section area of projectile [m$^2$]. |
| kf = $C_d*\rho*$area/2 | Resulting air drag factor. |
| findsecsol = 0 | 0: finding first solution.<br>1: finding second solution. |
| passfirsthit = 0 | Flag for preventing false detection of solution number two (1: function activated). |
| ninetydegreesdetected = 0 | Flag indicating when a 90° detection has been made (initial zeroing). |
| $\alpha_1 = 0.0$ | Angle of elevation of first solution (initial zeroing) [°]. |
| $timeofflight_1 = 0.0$ | Time of flight of first solution (initial zeroing) [s]. |
| $\alpha_2 = 0.0$ | Angle of elevation of second solution (initial zeroing) [°]. |
| $timeofflight_2 = 0.0$ | Time of flight of second solution (initial zeroing) [s]. |
| levelflag30 = 0 | See state 7 |
| levelflag60 = 0 | See state 7 |
| levelflag70 = 0 | See state 7 |
| levelflag89 = 0 | See state 7 |

State 2

The state ensures that the first trajectory is begun correctly.

| | |
|---|---|
| $\alpha_{tick} = 1$ | Initial setting of step variable for angle of elevation. |
| $\alpha_{launch} = -90$ | Initial value of angle of elevation $\alpha_{launch}$. |
| state = 3 | Next state = 3 |

State 3

After each new adjustment of $\alpha_{launch}$, the following steps must be taken. The state is activated from one of the states 2, 7 or 11.

| | |
|---|---|
| t = 0.0 | Zeroing of time before each new trajectory. |
| $X_v = 0.0$ | Zeroing of horizontal distance variable before the next trajectory. |

-continued

| | |
|---|---|
| $Z_v = 0.0$ | Zeroing of height variable (relative to target) before the next trajectory. |
| state = 4 | Next state = 4 |

State 4

The state is activated from one of the states 3, 5 or 12. At the time t=0.0, α and V must be given initial values for the current trajectory.

```
if (t = = 0.0)
{
α = α_launch      Initial value of α (attitude variable) is given from α_launch.
V = V_launch      Initial value of V (trajectory speed variable) is given
                  from V_launch.
}
```

Then the next position in the current trajectory is calculated $$V_x = V*\mathrm{COS}(\alpha*\mathrm{deg2rad}) - t_{tick}*(k_f*V^2*\mathrm{COS}(\alpha*\mathrm{deg2rad})/m)$$

$$V_x = V*\mathrm{SIN}(\alpha*\mathrm{deg2rad}) - t_{tick}*(g+k_f*V^2*\mathrm{SIN}(\alpha*\mathrm{deg2rad})/m)$$

$$V = \sqrt{V_x^2+V_x^2}$$

$$\alpha = ATAN\,(V_x/(V_x+1*10^{-20}))*\mathrm{rad2deg}$$

$$X_v = X_v + V_x*t_{tick}$$

$$Z_v = Z_v + V_z*t_{tick}$$

$$t = t + t_{tick}$$

where deg2rad means conversion from degrees to radians and rad2deg the reverse,

```
if (ninetydegreesdetected = = 0)
{
    if (z_v > z_p)                          If a 90° elevation has not
    {                                       yet been detected and z_v has
                                            just become greater than the
                                            z_p, a test is made to find out
                                            whether the throw is made
        if ((x_p = = 0) &&(α_launch > 89.9))  straight upwards.
        {
            α_1 = 90.0                      A first solution with 90°
            timeofflight_1 = t              elevation has been found.
                                            The current time is
                                            collected.
            ninetydegreesdetected = 1       Detection of 90° elevation
            state = 12                      is made.
        }
    }
}
else                                        If a 90° detection in a pre-
{                                           vious loop has been made,
    if (z_v < z_p)                          it is a fact that the projectile
    {                                       is located straight above z_p.
        if ((x_p = = 0) && (α_launch > 89.9))  When z_v < z_p, a further
                                            check is made to be perfect-
                                            ly sure.
        {
            α_2 = 90.0                      A second solution with 90°
            timeofflight_2 = t              elevation has been found.
                                            The current time is
                                            collected.
            state = 12
        }
```

-continued

```
    }
}                                   A check to decide whether
if (z_v < (lh − (2*acc)))           and when the projectile
{                                   passes the lower height
                                    limit. "- (2*acc)" is
                                    intended for the case when
                                    z_p = lh.
    state = 7                       Lower height limit passed.
}                                   Next state 7.
else
{
    state = 5                       Next state = 5
    }
```

State 5

The state finds the solutions that do not have the elevation 90°.

```
                                    Selection, depending on
if (findsecsol = = 0)               whether we search the
                                    first or the second solu-
                                    tion.
{                                   Searching the 1st solu-
                                    tion.
    if ((x_v > x_p) && (x_p <> 0.0))
    {
        state = 6                   The projectile has passed
                                    x_p. Not 90°.
    }                               Next state = 6.
    else
    {
        state = 4                   No global decision data.
    }                               Continue to validate
                                    trajectory.
}                                   Next state = 4.
else
{                                   Searching the 2nd solu-
                                    tion.
    if ((α < 0.0) && (z_v < z_p) && (x_p < 0.0))  Does the projectile have
    {                               a negative attitude, not
                                    90°, and has it also
                                    passed z_p?
        if (x_v < x_p)              Did it pass z_p in a falling
                                    motion while at the same
                                    time this happened be-
                                    fore x_p?
        {
            state =9                Yes, investigate how
        }                           close the projectile is to
                                    the searched position
                                    (x_p,z_p).
        else                        Next state = 9.
        {
            state = 7               No, the passing of z_p in a
        }                           falling motion occurred
                                    beyond x_p.
    else                            Next state = 7.
    {
            state = 4               No global decision data.
        }                           Continue to validate
                                    trajectory.
}                                   Next state = 4.
```

State 6

The state can only be activated from state 5.

```
                                    Has the projectile just passed
    if (z_v > z_p)                  x_p and at the same time above z_p?
    {
        state = 9                   Yes, investigate how close the
```

-continued

```
    }                               projectile is to the searched
                                    position (x_p,z_p).
    else                            Next state = 9.
    {
        state = 7                   The trajectory went too much
    }                               below the searched position in
                                    the searching for a 1st solution.
                                    Next state = 7.
```

State 7

Each value of $\alpha_{launch}$ that does not lead to a solution results in this state being activated. The state increments $\alpha_{launch}$ so that a new suitable trajectory can be executed once more. Depending on how great value $\alpha_{launch}$ has, incrementation is made in a suitable manner. An excessively high value of $\alpha_{tick}$ would lead to no final solution at all being obtained. The projectile path would simply miss decisive stages in this state logic. An excessively low value would radically increase the required time expenditure to solve the task. The greater $\alpha_{launch}$, the lower $\alpha_{tick}$ has to be so that the risk of error events can be fully eliminated.

```
If (α_launch > 30)
    Levelflag30 = 1
If (α_launch > 60)
    Levelflag60 = 1
if (α_launch > 70)
    levelflag70 = 1
if (α_launch > 89)
    levelflag89 = 1
α_tick = 10 −levelflag30 * 7 − levelflag60 * 2 − levelflag70 * 0.6 −
levelflag89 * 0.3
α_launch = α_launch + α_tick
if (α_launch > 90.0)
{
    state = 8                       The searched position (x_p,z_p)
}                                   lies outside the throwing range.
else                                Next state = 8.
{
    state = 3                       Execution of new trajectory.
}                                   Next state = 3.
```

State 8

The searched position $(x_p,z_p)$ lies outside the throwing range. Angles and times of flight are suitably given the value 0.0. When this state has been activated, the entire state process is terminated with the following final results.

$\alpha_1$=0.0

$\text{timeofflight}_1$=0.0

$\alpha_2$=0.0

$\text{timeofflight}_2$=0.0

State 9

The state is active either when it has been determined that successive approximation must be begun to find a solution (see 5) or when a false result of solution No. 2 must be prevented. It is here also determined when a solution has been found (see 4.).

First the radial error between searched and current position is calculated (see 1. below). In state 12, the flag "passfirsthit" is set to 1 when a first solution has been found. Immediately after calculating the next position in the trajectory, it is highly possible that state 9 will be active and that "diff" also in this case will be smaller than "acc/2". To prevent a false second solution from being detected by mistake, the state is interrupted in order to proceed to state 7 instead (see 3.).

When finally a most probable second solution is to be assessed for possible acceptance, 2. sees to it that the stop which "passfirsthit" has up to now constituted is released.

```
diff = √((x_v − x_p)^2 + (z_v − z_p)^2)          1.
if (diff > (acc/2) && passfirsthit = = 1)        2.
    passfirsthit = 0
if (diff > (acc/2) && passfirsthit = = 1)        3.
{
    state = 7
}
else
{
    if (diff < (acc/2))
    {
        state = 10                               4.
    }
    else
    {
        state = 11                               5.
    }
}
```

State 10

The state can only be activated from state 9. Then a non 90° solution has been found. If "findsecsol"=0 (i.e. before the first solution has been found) $\alpha_1$ and time of flight$_1$ are given the instantaneous values of $\alpha_{launch}$ and t, respectively. $\alpha_2$ and time of flight$_2$ are given corresponding values if "findsecsol"=1.

It is evident from the flow chart in FIG. 3 that when "findesecsol"=1, state 10 gives the values of the solution directly to solution 2 where all execution is terminated. At the same time it is evident from the code below that state 10 always proceeds directly to state 12, independently of whether the 1st or the 2nd solution has been sent. In this case, this difference is of no import whatever. The code lines that are presented for each state 1-12 are in fact direct extracts from an application written in C++. At the same time as it must be possible to terminate a program in a functional manner, a flow chart must be able to describe the function sufficiently clearly.

```
if (findesecsol = = 0)
{
    α_1 = α_launch
    timeofflight_1 = t
}
else
{
    α_2 = α_launch
    time of flight_2 = t
}
state = 12
```

State 11

This state can only be activated from state 9.

State 9 has established just before that the searched point $(x_p,z_p)$ has been passed in terms of elevation. Therefore, the search must first be reversed one step (see 1. below). Then $\alpha_{tick}$ is scaled down by a factor 10 (see 2.). In this way only 1/10 of the original incrementation is carried out (see 3.). Depending on whether the elevation lies above or below the point $(x_p,z_p)$ in terms of elevation in the next trajectory, there will be alternating cooperation between the ordinary $\alpha_{tick}$ from state 7 and the downscaling that will be done here. In this way, a kind of successive approximation that never misses a correct solution will always be provided.

$$\alpha_{launch}=\alpha_{launch}-\alpha_{tick} \quad 1.$$

$$\alpha_{tick}=\alpha_{tick}/10 \quad 2.$$

$$\alpha_{launch}=\alpha_{launch}+\alpha_{tick} \quad 3.$$

state=3

State 12

If findsecsol is still 0 when this state is entered, only the first solution has been found. Findsecsol and passfirsthit are first set to 1. Then it is checked whether a 90° detection has been made. If this is the case, the process is moved to state 4 so that the next position of the trajectory vertically can be calculated.

If ninetydegreesdetected=0, the process is moved to state 7, so that the next elevation can start being validated. If findsecsol=1 when state 12 is entered, the whole process is terminated. All of the possible solutions that are available with regard to the position and property parameters of the target have at that stage already been solved in state 4, 8 or 10.

```
if (findsecsol = = 1)
    break
findsecsol = 1
passfirsthit = 1
if (ninetydegreesdetected = = 1)
{
    state = 4
}
else
{
    state = 7
}
```

Having described an embodiment of the invention with reference to FIG. 3, some clarifications and reflections will be presented below with reference to FIG. 4, which shows a projectile in two positions in a trajectory in plane x, z. Accelerations on the projectile positions and their speeds have been indicated.

Before the first position calculation, initial values are given to $\alpha$ ($\alpha=\alpha_{launch}$) and V ($V=V_{launch}$). In the calculation of $V_x$ and $V_z$, see state 4, an approximation is made by using the preceding values of $\alpha$ and V. New values of $\alpha$ and V are then calculated with regard to $V_x$ and $V_z$. Then a simple updating of $X_v$ and $Z_v$ is made. Finally, t is adjusted upwards.

The acceleration a of the projectile in FIG. 4 can be written as $$a = \frac{f}{m}$$

where f in this case is a counteracting force caused by the air drag $f=-k_f*V^2$. Thus, the counteracting acceleration can be written as $$a = -\frac{k_f * V^2}{m},$$

which gives the horizontal acceleration component $a_k=-k_f*V^2*\mathrm{COS}(\alpha*\mathrm{deg2rad})/m$ and the vertical $a_z=-k_f*V^2*\mathrm{SIN}(\alpha*\mathrm{deg2rad})/m$.

The time step $t_{tick}$ is calculated initially and optimised with regard to acc and $V_{launch}$. By dimensioning $t_{tick}$ so that $t_{tick}$=acc/(4*$V_{launch}$), the radial distance between two neighbouring positions cannot be greater than acc. Thus, acc can fully determine the maximum inaccuracy in the final results for each of the two solutions. This requires that this discrete calculation method be sufficiently accurate in itself, i.e. when it is compared with the classical differential equation of a body in a trajectory with regard to the effect of the air drag and with a very small time step.

That, in the calculation of $t_{tick}$, the denominator contains a 4 and not a 2 is due to the fact that there are two different sources of errors that must be handled to guarantee that the solutions for angle of elevation and time of flight should be quite correct. One originates from the calculation error between classical differential equation and the discrete method described here, an error that cannot be greater than acc/2 (see the next paragraphs). By using a $t_{tick}$, which allows the flight path during the time $t_{tick}$ in the trajectory to be maximally ¼ of acc instead of ½, the maximum calculation error can be reduced to acc/2.

The second source of errors has a guaranteed maximum error which is acc/2 by all comparisons in state 9 being made relative to this value. By this is meant that when each solution is validated with its angle of elevation and time of flight, the trajectory certainly ends within an imaginary circle where the radius=acc and where its centre is placed precisely in the position that was indicated as input data, i.e. ($x_p$,$z_p$).

The present invention can be developed by taking into consideration, in various ways, different additional factors, such as wind force and wind direction and air density varying according to height. Basically, also in these cases the flow chart in FIG. 3 is used. Only minor corrections will be required.

In order to check the accuracy of the invention, in the basic form presented here, it has been examined by way of two methods created for the task. The first method is a simulation model, made in the program ACSL (Advanced Continuous Simulating Language) which offers the possibility of simulating time continuous functions where initial, discrete and derivative blocks can be provided with the respective program code for the intended purpose. The second method comprises the invention programmed in Visual $C^{++}$ 6.0, MFC Wisard.

A very large number of simulations and executions have been carried out. Then a comparison has been made between results from the two methods and the classical differential equation of trajectory validated in the program Mathcad 2000. In each comparison, all final positions have been within a circle with the radius acc which has the centre position ($x_p$,$z_p$).

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A method of calculating in near real-time two possible angles of elevation of a projectile and associated times of flight so that the projectile can be made to act at a desired point, c h a r a c t e r i s e d in that the azimuth angle of a vertical plane, the XZ plane, in which the launching direction of the projectile lies, is determined in a prior-art manner, for instance by direct measuring the direction to a target on which the projectile is to act, the origin is fixed at the starting point of the projectile and the X axis is fixed to be parallel to the horizontal plane, the angle of elevation and the time of flight are calculated in a process which is divided into two main parts, a calculation part and a logic part, where the calculation part, starting from the diameter (d), mass (m), air drag coefficient ($C_d$) and launching speed ($V_{launch}$) of the projectile, discretely timed calculates projectile positions and associated times of flight in a trajectory, and where the logic part, starting from a maximum inaccuracy in the logic part (acc), a lower limit of the desired height (lh), the horizontal distance to the target ($x_p$) and the relative height to the target ($z_p$), sets a first direction of elevation ($\alpha_{launch}$), monitors the calculation of projectile positions and time of flight, and interrupts the calculation either, when the projectile lies within a circle of acceptance with the desired point at the centre and with the radius equal to half the value of the inaccuracy (acc) of the logic part and determines the current values of direction of elevation and time of flight as a solution, or when a calculated projectile position lies outside a predetermined boundary condition, and after that, until two solutions have been found, sets a second direction of elevation.

2. A method as claimed in claim 1, c h a r a c t e r i s e d by first calculating a time step ($t_{tick}$) which is used in the calculation part as said maximum inaccuracy (acc) divided by at least 4 times the launching speed ($V_{launch}$).

3. A method as claimed in claim 1, c h a r a c t e r i s e d by fixing as a first angle of elevation one that is with certainty below or equal to the lowest of the angles of elevation of the solution.

4. A method as claimed in claim 1, c h a r a c t e r i s e d by iterating positions in a trajectory as follows $$V_{x=V*COS(\alpha*deg2\ rad)}—t_{tick*(kf}*V^2*COS(\alpha*deg2\ rad)/m)$$

$$V_{z=V*SIN(\alpha*deg2\ rad)}—t_{tick*(gf}*V^2*SIN(\alpha*deg2\ rad)/m)$$

giving $$X_v=X_v+V_x*t_{tick}$$

$$Z_v=Z_v+V_z*t_{tick}$$

$$t=t+t_{tick}$$

wherein $X_v$ is the most recently calculated position in X direction and $Z_v$ the same in Z direction, $V_x$ is the most recently calculated speed in X direction and $V_z$ the same in Z direction, $V=\sqrt{V_x^2+V_z^2}$ is the most recently calculated resulting speed in the plane X,Z, $$\alpha=ATAN(V_z/(V_x+1*10^{-20}))*rad2\ deg$$

deg2rad means conversion from degrees to radians and rad2deg the reverse, $k_{f=Cd*\rho*\ area/}2$ is the resulting air drag coefficient, with ρequal to the density of the air, m is the mass and g is the acceleration of gravity and wherein αis fixed at $\alpha_{launch}$ and V is fixed at $V_{launch}$ at the starting time t =0.

5. A method as claimed in claim 4, c h a r a c t e r i s e d in that the iteration proceeds until the most recently calculated position in X direction, $x_v$, is greater than the distance to the target in X direction, $x_p$, and the distance between the start position and the target position in X direction is different from zero, and after that it is determined whether the trajectory lies within said circle of acceptance, which means that it will be established that a first solution has been found in angle of elevation and time of flight for a trajectory, or otherwise whether the trajectory lies above or below the target.

6. A method as claimed in claim 5, c h a r a c t e r i s e d by selecting a new greater angle of elevation if the trajectory lies below the target.

7. A method as claimed in claim 5, c h a r a c t e r i s e d by returning, if the trajectory lies above the target, to the immediately preceding angle of elevation which gave a trajectory below the target, and beginning a new series of calculations of positions and times along trajectories by a step of increase in the direction of elevation which is a fraction, for instance one tenth, of the previous step of increase.

8. A method as claimed in claim 5, c h a r a c t e r i s e d by starting, if the solution is a first solution, the calculation of a second solution, which is initiated by another angle of elevation being selected, except in the cake where the first angle of elevation is 90 ° , i.e. straight upwards, when the same angle of elevation is selected.

9. A method as claimed in claim 8, c h a r a c t e r i s e d in that the iteration proceeds until the most recently calculated position in Z direction, $z_v$, is smaller than the distance to the target in Z direction, $z_p$, and that both $\alpha$is less than zero and the distance between the start position and the target position in X direction is different from zero, and, after that, it is determined whether the trajectory lies within said circle of acceptance, which means that a second solution has been found in angle of elevation and time of flight for a trajectory, or otherwise whether in X direction it lies on this side of or beyond the position of the target seen from the start position.

10. A method as claimed in claim 9, c h a r a c t e r i s e d by selecting a new greater angle of elevation if the trajectory lies beyond the target in X direction.

11. A method as claimed in claim 9, c h a r a c t e r i s e d by returning, if the trajectory lies on this side of the target in X direction, to the immediately preceding angle of elevation which gave a trajectory beyond the target, and beginning a new series of calculations of positions and times along trajectories by a step of increase in the direction of elevation which is a fraction, for instance one tenth, of the previous step of increase.

12. A method as claimed in claim 6, c h a r a c t e r i s e d in that the selection of an increase of the angle of elevation decreases with an increasing angle of elevation.

13. method as claimed in claim 1, c h a r a c t e r i s e d by using in the calculations an air drag coefficient ($C_d$) which varies in dependence on temperature, atmospheric pressure and air humidity.

14. method as claimed in claim 3, c h a r a c t e r i s e d by fixing 90°as the first angle of elevation.

15. A method as claimed in claim 10, c h a r a c t e r i s e d in that the selection of an increase of the angle of elevation decreases with an increasing angle of elevation.

* * * * *